US007528346B2

(12) United States Patent
Serra et al.

(10) Patent No.: US 7,528,346 B2
(45) Date of Patent: May 5, 2009

(54) INTERNAL COMBUSTION ENGINE PROVIDED WITH A HEATING DEVICE IN A COMBUSTION CHAMBER AND A CONTROL METHOD FOR THE HEATING DEVICE

(75) Inventors: Gabriele Serra, S. Lazzaro di Savena (IT); Matteo De Cesare, Torremaggiore (IT)

(73) Assignee: Magneti Marelli PowerTrain S.p.A., Corbetta (IT)

( * ) Notice: Subject to any disclaimer, the term of this patent is extended or adjusted under 35 U.S.C. 154(b) by 427 days.

(21) Appl. No.: 11/418,458

(22) Filed: May 5, 2006

(65) Prior Publication Data

US 2006/0289425 A1 Dec. 28, 2006

(30) Foreign Application Priority Data

May 6, 2005 (IT) ..... BO2005A0326

(51) Int. Cl.
*F23Q 7/22* (2006.01)
*F02B 53/12* (2006.01)

(52) U.S. Cl. ..... 219/270; 123/210

(58) Field of Classification Search ..... 219/270, 219/260, 261, 262, 263, 264, 265, 266, 267, 219/268, 269; 123/210, 211, 260, 287, 305, 123/179.6

See application file for complete search history.

(56) References Cited

U.S. PATENT DOCUMENTS

| | | | | |
|---|---|---|---|---|
| 3,512,221 | A * | 5/1970 | Schoerner | 428/606 |
| 3,539,970 | A * | 11/1970 | Rose et al. | 439/48 |
| 4,002,882 | A * | 1/1977 | McCutchen | 219/499 |
| 4,552,102 | A * | 11/1985 | Egle | 123/179.21 |
| 6,148,258 | A * | 11/2000 | Boisvert et al. | 701/99 |
| 6,434,944 | B2 * | 8/2002 | White | 60/670 |
| 6,906,288 | B2 | 6/2005 | Toedter et al. | |
| 2001/0027652 | A1 * | 10/2001 | White | 60/645 |

FOREIGN PATENT DOCUMENTS

| | | |
|---|---|---|
| DE | 103 18 241 A1 | 11/2004 |
| EP | 1 408 233 | 4/2004 |
| WO | WO 95/06203 | 3/1995 |

* cited by examiner

*Primary Examiner*—Daniel L Robinson
(74) *Attorney, Agent, or Firm*—Jacobson Holman PLLC

(57) ABSTRACT

An internal combustion engine comprising at least one cylinder provided with at least one glow plug adapted to heat a variable volume combustion chamber within the cylinder, and an electronic control unit which in turn comprises an estimation module adapted to estimate the temperature of the glow plug within the combustion chamber and a control module which is adapted to drive the glow plug as a function of the estimated temperature.

13 Claims, 2 Drawing Sheets

INTERNAL COMBUSTION ENGINE PROVIDED WITH A HEATING DEVICE IN A COMBUSTION CHAMBER AND A CONTROL METHOD FOR THE HEATING DEVICE

The present invention relates to an internal combustion engine provided with a heating device in a combustion chamber, and to a control method for the heating device.

BACKGROUND OF THE INVENTION

As is known, the combustion chambers of internal combustion engines, in particular diesel engines, are provided with heating devices, known typically as "glow plugs", whose function is appropriately to heat the combustion chambers and the operating fluid in these chambers so as to ensure a certain efficiency of the combustion process, even in operating conditions which are not optimal, for instance at a low temperature of the combustion chamber and/or of the operating fluid.

In internal combustion engines, one of the most critical of the operating conditions to which the combustion process is subject, and in which the use of glow plugs is required, is in particular the engine ignition phase.

In this phase, in practice, the temperature of the combustion chamber is low, i.e. it is lower than the working temperature required to obtain a sufficiently efficient combustion process; a supply voltage is therefore supplied to the glow plug so to bring the temperature of the latter to a value equal to an objective temperature to be reached in working conditions.

It is also known that one of the most important requirements for the drivers of vehicles with internal combustion engines is the need to reduce to a minimum the preheating time of the glow plug, which corresponds to the time interval taken by the plug, during the ignition phase of the engine, to bring its temperature to a value equal to the objective temperature.

For this purpose, open loop electronic control systems adapted to drive the glow plug so as to reduce the preheating time have been proposed in the latest generation internal combustion engines. During the engine ignition phase, these electronic control systems in particular boost the supply voltage of the glow plug, i.e. they increase the supply voltage to a value greater than the nominal voltage supplied to the glow plug in normal working conditions, in order to cause the temperature of the glow plug to increase extremely rapidly, thereby obtaining a reduction of the preheating time.

At the end of the ignition phase, the control system stabilises the supply voltage of the glow plug to the nominal value in order to maintain its temperature at a value substantially equal to the objective temperature.

Although they reduce the preheating time of the glow plug, the electronic control systems discussed above have a number of drawbacks: first, the supply of an overvoltage to the glow plug may damage it when the initial conditions of the plug and the combustion chamber differ from the conditions set in the control; in practice, if the ignition, rather than taking place from a "cold" engine, takes place from a "hot" engine, i.e. at a temperature slightly lower than the working temperature, then the supply of an overvoltage to the glow plug may generate an extremely high temperature which is higher than the temperature that can be tolerated by the glow plug, thereby subjecting the latter to excessive thermal stresses which it is unable to withstand.

A second drawback lies in the fact that the open loop electronic control systems discussed above do not ensure that the plug temperature remains stable enough with variations of those of the engine operating parameters which to some extent cause a change of temperature in the combustion chamber. In other words, the control of the glow plug temperature carried out by the above-mentioned electronic control systems is not very reliable as the temperature parameter to be controlled is conditioned by a number of engine parameters and by a number of environmental conditions to which the plug is exposed.

In order to reduce the preheating time, self-regulating glow plugs have also been proposed and are provided with an internal varistor which varies their resistance as a function of temperature so as to cause an automatic regulation of the thermal power generated, thereby obtaining an automatic control of the temperature of the glow plug.

These self-regulating glow plugs have the drawback that they are subject to a degree of temperature dispersion in the various operating conditions of the engine; in practice, as the engine operating point varies there is a change in the heat exchange and the self-regulating glow plug is unable appropriately to adapt its heating power, and is thus subject to higher temperature variations.

EP-1408233 discloses a process for controlling the heating of glow plugs in a diesel engine comprises emulating the thermal behavior of the plug on heating, and WO-9506203 relates to a method of driving a heating element such as a glow plug from an electrical power supply.

SUMMARY OF THE INVENTION

The object of the present invention is to provide an internal combustion engine provided with a heating device and a control method for the heating device, which makes it possible to reduce the preheating time of the heating device and, at the same time, ensures that the temperature of the heating device remains very stable in any operating condition of the engine.

The present invention relates to an internal combustion engine provided with a heating device as claimed in the attached Claims.

The present invention further relates to a control method for a heating device in an internal combustion engine, as claimed in the attached Claims.

The present invention further relates to an electronic control unit for the control of a heating device in an internal combustion engine as claimed in the attached Claims.

BRIEF DESCRIPTION OF THE DRAWINGS

The present invention is described below with reference to the accompanying drawings, which show various non-limiting embodiments thereof, and in which.

DETAILED DESCRIPTION OF THE INVENTION

The principle on which the present invention is based is essentially that of carrying out a feedback control (i.e. a closed loop control) of the temperature of the heating device in a variable volume combustion chamber of an internal combustion engine, as a function of an estimation of the temperature of this heating device; this estimate is carried out using an energy balance model of the thermal powers generated and exchanged within the combustion chamber.

In other words, the present invention is based on the notion of estimating the temperature of the heating device on the basis of an energy balance between the thermal power developed by the heating device, and the thermal power exchanged between the combustion chamber and the operating fluid contained in this combustion chamber, and of driving the heating device as a function of the difference between the estimated temperature and an objective temperature which needs to be reached by the heating device in a particular engine operating condition.

Figure 1:
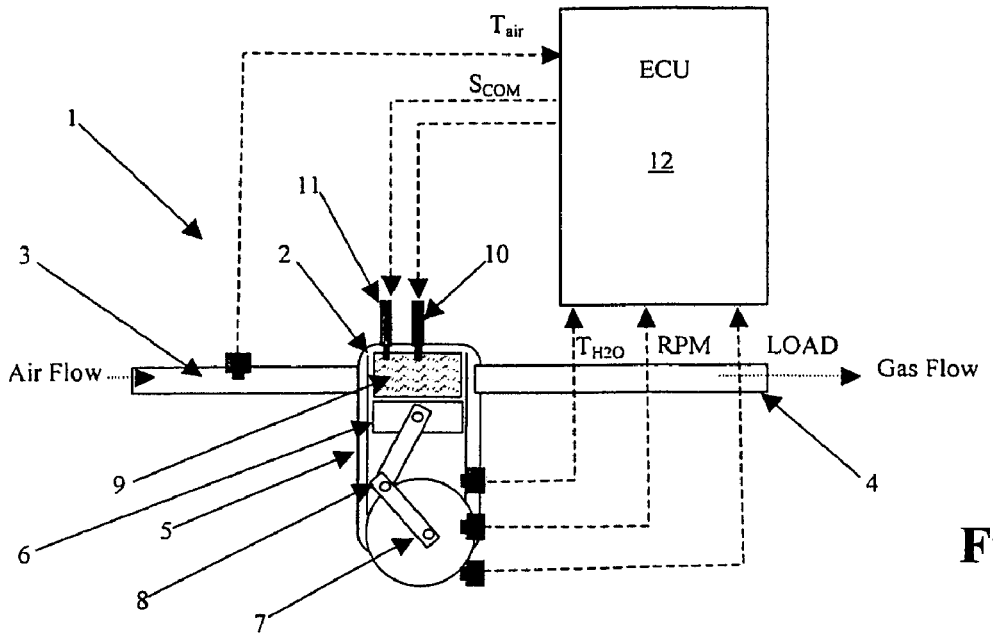
FIG. 1 is a diagrammatic view of an internal combustion engine provided with a heating device embodied in accordance with the present invention.

With reference to FIG. 1, an internal combustion engine, preferably a diesel engine, is shown overall in diagrammatic form by reference numeral 1 and comprises a series of cylinders 2 (only one of which is shown for clarity of illustration) and, for each cylinder 2, an intake duct 3 connected to the relative cylinder 2 in order to provide a flow of air as input to the cylinder 2, an exhaust duct 4 connected to the cylinder 2 in order to receive the flow of air containing the exhaust gases from that cylinder, and a cooling device 5 which is of a known type and is not therefore described in detail, which is traversed internally by a flow (of water, for instance) adapted to cool the internal combustion engine 1.

Each cylinder 2 is coupled to a piston 6 which is adapted to slide in a linear manner along the cylinder 2 and is mechanically coupled to a drive shaft 7 by a connecting rod 8. The free space within the cylinder 2 and bounded by the piston 6 forms, as is known, a variable volume combustion chamber 9 in the cylinder 2.

Each cylinder 2 further comprises an injector 10 adapted cyclically to inject fuel into the cylinder 2 and at least one heating device which, in the embodiment shown, is formed by a glow plug 11 adapted to heat the combustion chamber 9.

Figure 2:
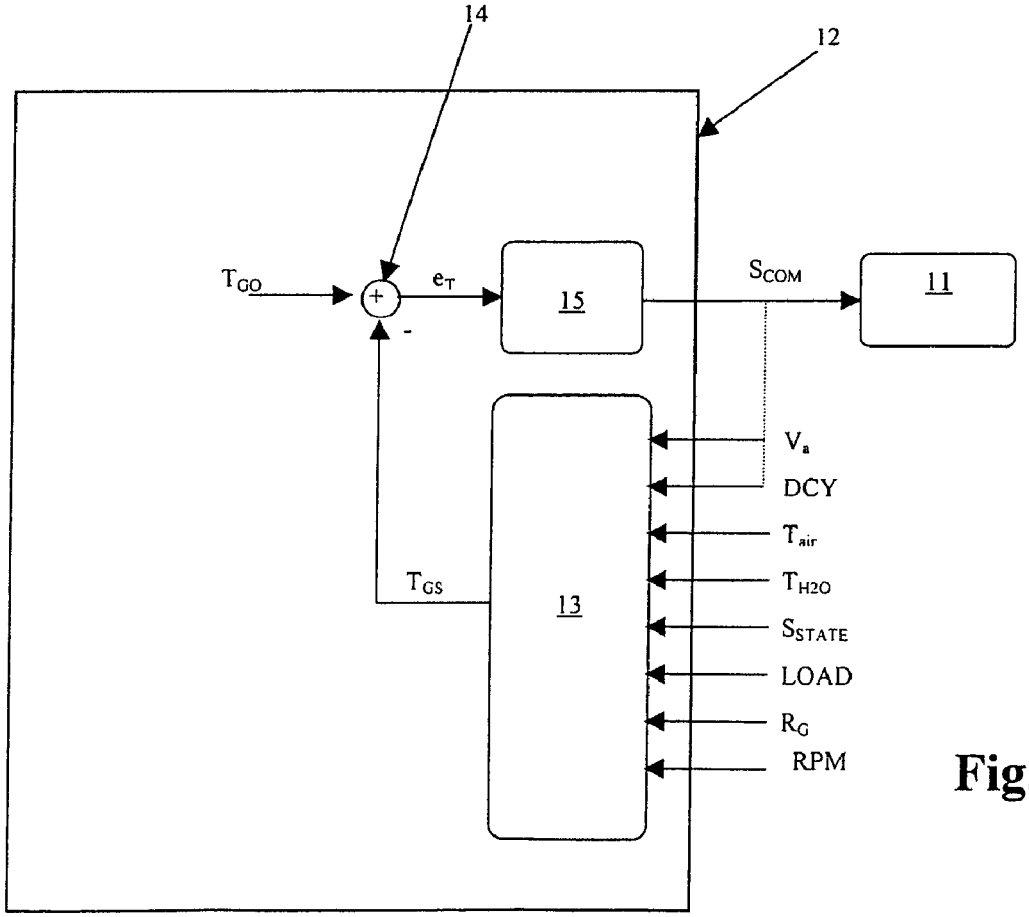
FIG. 2 is a block diagram of an electronic control unit forming part of the internal combustion engine shown in FIG. 1.

With reference to FIGS. 1 and 2, the internal combustion engine 1 is further provided with an electronic control unit 12 which supervises the operation of the engine 1 and is adapted, in particular, to drive the glow plug 11 in order to heat the combustion chamber 9 in accordance with a control method which is described in detail below.

In particular, the electronic control unit 12 estimates, instant by instant, the temperature $T_{GS}$ of the glow plug 11 and adjusts the electrical power to be supplied to the glow plug 11 as a function of this estimated temperature $T_{GS}$.

With reference to the embodiment shown in FIG. 2, the electronic control unit 12, of which only those components essential for comprehension of the present invention are shown, comprises an estimation module 13 which receives as input a series of engine magnitudes and operating parameters, and is adapted to generate as output, as a function of the latter, a signal indicating the estimated temperature $T_{GS}$ of the glow plug 11. It should be noted, with respect to the above description, that the operating parameters are supplied to the electronic control unit 12 by a series of known sensors and/or transducers and/or measurement devices installed at various appropriate points of the engine.

The electronic control unit 12 further comprises, a summing circuit 14 which receives as input a signal indicating the estimated temperature $T_{Gs}$ and a signal indicating an objective temperature $T_{GO}$ corresponding to the temperature that needs to be reached by the glow plug 11, and supplies as output an error signal $e_T$ showing the difference between the objective temperature $T_{GO}$ to be reached and the estimated temperature $T_{GS}$.

The electronic control unit 12 further comprises a control module 15 which receives as input the error signal $e_T$ and generates, as a function of the latter, a control signal $S_{COM}$ which drives the glow plug 11. In particular, the control module 15 preferably generates the control signal $S_{COM}$ by a pulse width modulation PWM. In this case, the control signal $S_{COM}$ comprises a series of pulses characterised by a voltage value $V_a$ and by a specific duty cycle whose value is shown below by DCY.

The control module 13 is adapted appropriately to modulate the duty cycle DCY and/or the voltage value $V_a$ of the control signal $S_{COM}$ to be supplied to the glow plug 11 as a function of the error signal $e_T$ so as to supply thereto a specific electrical power such that a corresponding thermal power can be generated by means of this plug 11.

Figure 3:
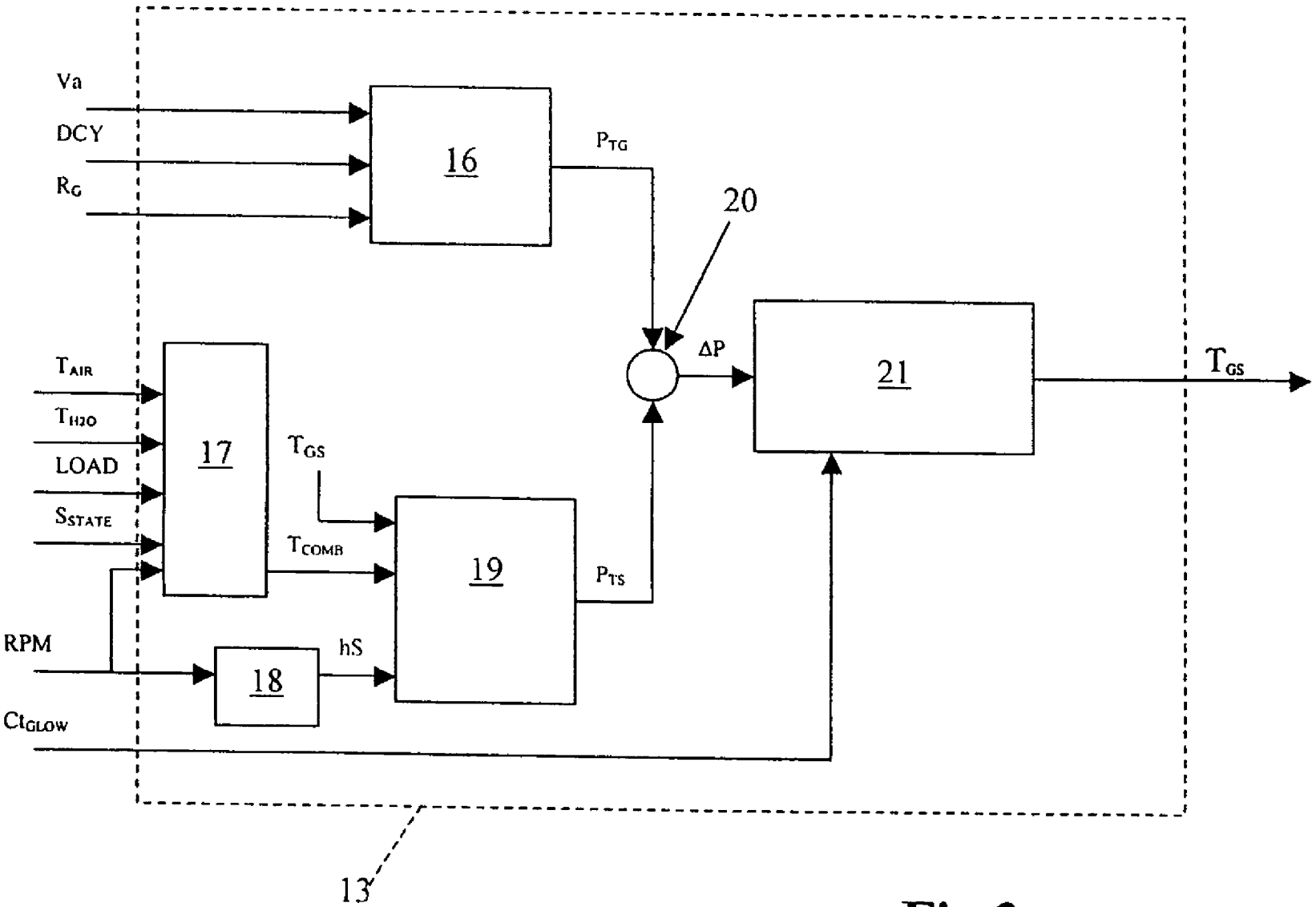
FIG. 3 is a block diagram of a temperature estimation module of the electronic control unit of the internal combustion engine shown in FIG. 2

With reference to FIG. 3, the estimation module 13 comprises a block 16 which receives as input a signal correlated with the voltage $V_a$ of the control signal $S_{COM}$, a signal indicating the duty cycle DCY of the control signal $S_{COM}$ generated by the control module 15 and a signal indicating the electrical resistance $R_G$ of the glow plug 11.

The block 16 is adapted to process the parameters $V_a$, DCY and $R_G$ so as to provide as output a signal indicating the thermal power $P_{TG}$ generated by the glow plug 11 when the latter is supplied with the control signal $S_{COM}$. In this case, the block 16 is adapted to calculate the thermal power $P_{TG}$ by implementing the following relationship:

$$P_{TG}=(V_a^2 \cdot DCY)/(R_G)$$

The estimation module 13 further comprises a block 17 which is adapted to calculate the mean temperature $T_{COMB}$ in the combustion chamber 9 and a block 18 adapted to calculate a heat exchange coefficient hS.

The block 17 in particular receives as input a signal indicating the temperature $T_{AIR}$ of the intake air, a signal indicating the temperature $T_{H2O}$ of the cooling fluid, a signal indicating a parameter LOAD corresponding to the load measured in the engine 1, a signal indicating the number of engine revolutions RPM and a signal indicating the operating state of the engine $S_{STATE}$.

In this case, the signal indicating the operating state of the engine $S_{STATE}$ comprises, alternatively, a first operating state corresponding to a condition in which the engine is caused to rotate by the combustion process, or a second state corresponding to a condition in which the engine is stationary, or a third state corresponding to a condition in which the engine is caused to rotate in the absence of a combustion process. In more detail, the first state may correspond, for instance, to the condition in which the engine is driven in rotation by the combustion process and has achieved a number of revolutions greater than a predetermined minimum value (for instance 780 RPM), the second operating state of the engine may correspond to a condition of non-combustion in which the engine is driven in rotation by an electrical starter device (starter motor) at a speed of rotation of approximately 250 RPM, while the third state may correspond to the condition in which the engine is stationary and the ignition key is in a Key On state.

It will be appreciated that the signal indicating the operating state of the engine $S_{STATE}$ may be generated by a supervision module (not shown) of known type which is able, instant by instant, to determine the operating condition of the engine, while the signal indicating the parameter LOAD may be generated by a sensor mounted on the engine to measure its load (as shown in FIG. 1), or may be directly estimated by a calculation module of the electronic control unit 12 (not shown).

The block 17 determines the temperature $T_{COMB}$ of the combustion chamber 9 by means of a series of functions stored in a memory (not shown) of the electronic control unit 12, each of which is selected by the block 17 as a function of the engine operating state $S_{STATE}$. In this case, a first table containing a number of numerical values defining a first estimation function $F_{ST1}$ (RPM, LOAD) of the temperature $T_{COMB}$ is stored in the memory (not shown) and is associated with the first engine operating state, making it possible to estimate, for each combination of the speed values RPM and the load LOAD, a corresponding value of the temperature $T_{COMB}$.

A second table containing a plurality of numerical values defining a second estimation function $F_{ST2}$ ($T_{H2O}$) of the temperature $T_{COMB}$ is further stored in the memory (not shown) and is associated with the second engine operating state, making it possible to estimate, for each value of the temperature of the cooling fluid $T_{H2O}$, a corresponding value of the temperature $T_{COMB}$, as well as a third table containing a plurality of numerical values defining a third estimation function $F_{ST3}$ ($T_{AIR}$) of the temperature $T_{COMB}$, which is associated with the third operating state of the engine, making it possible to estimate, for each value of the temperature of the intake air $T_{AIR}$, a corresponding value of the temperature $T_{COMB}$.

The block 18 receives as input the signal indicating the number of revolutions RPM and calculates, by means of a heat exchange function H(RPM), the heat exchange coefficient hS of the combustion chamber 9. In this case, a fourth table containing a plurality of numerical values defining the heat exchange function H(RPM) is stored in the memory (not shown), making it possible to calculate a corresponding heat exchange coefficient hS for each value of the number of engine revolutions RPM.

The estimation module 13 further comprises a block 19 which receives as input the signal indicating the heat exchange coefficient hS, the signal indicating the temperature $T_{COMB}$ and a signal indicating the temperature $T_{GS}$ of the glow plug 11. It will be appreciated that the temperature $T_{GS}$ may be stored from time to time in the memory (not shown) and that the block 19 receives as input the signal corresponding to the last value of the temperature $T_{GS}$ calculated by the estimation module 13 during the previous estimation. It will also be appreciated that during the initial setting of the electronic control unit 12, when the estimation module 13 is operating for the first time, it is possible to assign an appropriate predetermined value to the temperature $T_{GS}$.

The block 19 processes the parameters $T_{GS}$, $T_{COMB}$ and hS in order to provide as output a signal indicating the thermal power $P_{TS}$ exchanged with the operating fluid in the combustion chamber 9. In this case, the block 19 calculates the thermal power $P_{TS}$ exchanged by means of the following relationship:

$$P_{TS}=hS(T_{GS}-T_{COMB})$$

The estimation module 13 further comprises a summing circuit 20 which receives as input the signal corresponding to the thermal power $P_{TG}$ generated and the signal indicating the thermal power $P_{TS}$ exchanged and supplies as output a signal indicating the difference ΔP between the thermal power $P_{TG}$ generated and the thermal power $P_{TS}$ exchanged: $\Delta P=(P_{TG}-P_{TS})$.

The estimation module 13 lastly comprises a block 21 which is adapted to receive as input the signal indicating the difference ΔP between the thermal power $P_{TG}$ generated and the thermal power $P_{TS}$ exchanged, and a signal indicating the thermal capacity $C_{tGLOW}$ of the glow plug 11, whose value is predetermined, and processes the latter in order to supply as output the signal indicating the estimated temperature $T_{GS}$ of the glow plug 11. In this case, the block 21 is adapted to estimate the temperature $T_{GS}$ of the glow plug 11 by means of the following relationship:

$$T_{GS} = \frac{1}{C_{tGLOW}} \cdot \int_{t_0}^{t} \Delta P \cdot dt$$

in which the instants $t_o$ and t bound the time interval during which the energy balance between the thermal power $P_{TG}$ generated by the glow plug 11 and the thermal power $P_{TS}$ exchanged in the combustion chamber 9 with the operating fluid (exhaust gas) is carried out.

In the control method for the glow plug 11, the estimation module 13 of the electronic control unit 12 estimates, instant by instant, the temperature $T_{GS}$ on the basis of the different engine parameters discussed above and the state of operation of this engine (first, second or third state) and the control module 15 appropriately modulates the control signal (in particular the duty cycle DCY and/or the voltage $V_a$) to be supplied to the glow plug 11, as a function of the error signal $e_T$ indicating the difference between the objective temperature $T_{GO}$ to be reached by the glow plug 11 and the estimated temperature $T_{GS}$.

The block 17 in particular identifies in the memory (not shown), on the basis of the operating state $S_{STATE}$ of the engine, the estimation function to be used to calculate the internal temperature $T_{COMB}$. In further detail, if the operating state $S_{STATE}$ corresponds to the first state, the block 17 calculates the internal temperature $T_{COMB}$ using the first estimation function $F_{ST1}$ (RPM, LOAD) on the basis of the speed RPM, and the load LOAD of the engine; while, if the operating state corresponds to the second or third state, the block 17 calculates the internal temperature $T_{COMB}$ using the second and third estimation functions $F_{ST2}$ ($T_{H2O}$), $F_{ST3}$ ($T_{AIR}$) on the basis of the temperature of the fluid $T_{H2O}$ and the temperature of the air $T_{AIR}$ respectively.

During this phase, the block 19 receives as input the signals corresponding to the parameters $T_{GS}$, $T_{COMB}$ and hS, processes them and supplies as output the thermal power $P_{TS}$ exchanged, and at the same time the block 16 processes the parameters Va, DCY and $R_G$ to provide as output the signal indicating the thermal power $P_{TG}$ generated. At this point, the module 21, following the subtraction operation between the thermal power $P_{TG}$ generated and the thermal power $P_{TS}$ exchanged, implemented by the summing circuit 20, estimates the temperature $T_{GS}$ of the glow plug 11 to be provided as output in the form of an electrical signal to the summing circuit 14.

The engine 1 and the control method of the glow plug 11 described above have the advantage of ensuring a precise and stable control of the temperature of the glow plug in any operating condition of the engine, at the same time ensuring a major reduction of the preheating time of this plug during the ignition phase. In contrast to known electronic control systems which, as described above, implement an open loop control of the temperature, the method described above implements a feedback control of the temperature, thereby improving engine performance both in the ignition phase and in normal working conditions.

The engine and the control method of the heating device described above have the advantage that they are simple and economic to embody as they enable a direct closed loop control of the temperature of the heating device based on the engine magnitudes typically available, without needing to use a temperature sensor mounted directly on the heating device, which latter solution, in addition to being extremely complex to industrialise, would also entail very high costs. It will be appreciated that the engine and the control method of the heating device as described and illustrated may be modified and varied without thereby departing from the scope of the present invention as set out in the accompanying claims.

What is claimed is:

1. An internal combustion engine comprising at least one cylinder provided with at least one heating device adapted internally to heat a variable volume combustion chamber of the cylinder and an electronic control unit adapted to drive the heating device so as to vary a temperature of the heating device, the electronic control unit including an estimation device adapted to estimate a temperature ($T_{GS}$) of the heating device within the combustion chamber and a control device adapted to drive the heating device as a function of the estimated temperature ($T_{GS}$), said estimation device including a first calculation device adapted to calculate a thermal power ($P_{TG}$) generated by the heating device, a second calculation device adapted to calculate a thermal power ($P_{TS}$) exchanged within the combustion chamber, and a third calculation device adapted to estimate the temperature ($T_{GS}$) of the heating device as a function of a difference between the thermal power ($P_{TG}$) generated and the thermal power ($P_{TS}$) exchanged, the second calculation device including a fourth calculation device adapted to calculate an internal temperature ($T_{COMB}$) of the combustion chamber and a fifth calculation device adapted to calculate the thermal power ($P_{TS}$) exchanged as a function of the difference between the internal temperature ($T_{COMB}$) of the combustion chamber and the estimated temperature ($T_{GS}$) of the heating device.

2. The engine as claimed in claim 1, wherein the third calculation device is adapted to estimate the temperature ($T_{GS}$) of the heating device by a relationship:

$$T_{GS} = \frac{1}{C_{tGLOW}} \cdot \int_{t_0}^{t} \Delta P \cdot dt$$

in which instants $t_o$ and t bound a time interval during which an energy balance is carried out, ΔP is a difference between the thermal power ($P_{TG}$) generated and the thermal power ($P_{TS}$) exchanged, and $C_{tGLOW}$ is a thermal capacity of the heating device.

3. The engine as claimed in claim 1, wherein the control device is adapted to generate a control signal ($S_{COM}$) for the heating device, the control signal ($S_{COM}$) including a series of pulses (PWM), the first calculation device being adapted to calculate the thermal power ($P_{TG}$) generated as a function of a series of parameters including at least one of a voltage (Va) of the control signal ($S_{COM}$), a duty cycle (DCY) of the pulses of the control signal ($S_{COM}$), and an electrical resistance ($R_G$) of the heating device.

4. The engine as claimed in claim 1, wherein the fifth calculation device is adapted to calculate the thermal power ($P_{TS}$) exchanged by a relationship: $P_{TS}=hS(T_{GS}-T_{COMB})$ in which $P_{TS}$ is a thermal power exchanged, $T_{GS}$ is the estimated temperature, $T_{COMB}$ is the temperature of the combustion chamber, and hS is a heat exchange coefficient.

5. The engine as claimed in claim 1, wherein the fourth calculation device is adapted to calculate the temperature ($T_{COMB}$) of the combustion chamber as a function of a series of engine parameters ($T_{AIR}$, $T_{H2O}$, LOAD, RPM) and on a basis of an operating state ($S_{STATE}$) of the engine.

6. The engine as claimed in claim 3, wherein the control device is adapted to generate the control signal ($S_{COM}$) as a function of a difference between an objective temperature ($T_{GO}$) which is to be reached by the heating device and the estimated temperature ($T_{GS}$).

7. A control method for an internal combustion engine having at least one cylinder provided with at least one heating device adapted internally to heat a variable volume combustion chamber of the cylinder, the control method comprising a stage of driving the heating device so as to vary a temperature thereof, including estimating a temperature ($T_{GS}$) of the heating device within the combustion chamber and driving the heating device as a function of the estimated temperature ($T_{GS}$), the stage of estimating the temperature ($T_{GS}$) of the heating device including calculating a thermal power ($P_{TG}$) generated by the heating device, calculating a thermal power ($P_{TS}$) exchanged in the combustion chamber, and estimating the temperature ($T_{GS}$) of the heating device as a function of a difference between the thermal power ($P_{TG}$) generated and the thermal power ($P_{TS}$) exchanged, the stage of calculating the thermal power ($P_{TS}$) exchanged including calculating an internal temperature ($T_{COMB}$) in the combustion chamber and calculating the thermal power ($P_{TS}$) exchanged as a function of a difference between the internal temperature ($T_{COMB}$) in the combustion chamber and the estimated temperature ($T_{GS}$) of the heating device.

8. A The control method as claimed in claim 7, wherein the stage of estimating the temperature ($T_{GS}$) of the heating device includes a stage of implementing a relationship:

$$T_{GS} = \frac{1}{C_{tGLOW}} \cdot \int_{t_0}^{t} \Delta P \cdot dt$$

in which instants $t_o$ and t bound a time interval during which an energy balance is carried out, ΔP is a difference between the thermal power ($P_{TG}$) generated and the thermal power ($P_{TS}$) exchanged, and $C_{tGLOW}$ is a thermal capacity of the heating device.

9. The control method as claimed in claim 7, wherein the stage of driving the heating device includes a stage of generating a control signal ($S_{COM}$) for the heating device, the control signal ($S_{COM}$) including a series of pulses (PWM), the stage of calculating the thermal power ($P_{TG}$) generated including the stage of calculating the thermal power ($P_{TG}$) generated as a function of a series of parameters including at least one of a voltage (Va) of the control signal ($S_{COM}$), a duty cycle (DCY) of the control signal ($S_{COM}$) , and an electrical resistance ($R_G$) of the heating device.

10. The control method as claimed in claim 7, wherein the thermal power ($P_{TS}$) exchanged is calculated by a relationship: $P_{TS}=hS(T_{GS}-T_{COMB})$ in which $P_{TS}$ is the thermal power exchanged, $T_{GS}$ is the estimated temperature, $T_{COMB}$ is the temperature of the combustion chamber, and hS is a heat exchange coefficient.

11. The control method as claimed in claim 7, wherein the stage of calculating the internal temperature ($T_{COMB}$) in the combustion chamber is a function of a series of engine parameters ($T_{AIR}$, $T_{H2O}$, LOAD, RPM) and an operating state ($S_{STATE}$) of the engine.

12. The control method as claimed in claim 9, wherein the stage of generating the control signal ($S_{COM}$) is a function of a difference between an objective temperature ($T_{GO}$) which is to be reached by the heating device and the estimated temperature ($T_{GS}$).

13. An electronic control unit for an internal combustion engine, the engine having at least one cylinder provided with at least one heating device adapted internally to heat a variable volume combustion chamber of the cylinder, the control unit comprising a configuration to implement the control method for the heating device as claimed in claim 7.

* * * * *